US005927594A

United States Patent [19]

Gianpaolo

[11] Patent Number: 5,927,594

[45] Date of Patent: Jul. 27, 1999

[54] METHOD FOR FASTENING A CLOSURE TO A CONTAINER OF LIQUID, GRANULAR OR POWDERY PRODUCTS, AND CONTAINER SO ACHIEVED

[75] Inventor: Belloli Gianpaolo, Pianoro, Italy

[73] Assignee: Catta 27 S.r.l., Cresellano, Italy

[21] Appl. No.: 08/973,534

[22] PCT Filed: Jun. 26, 1996

[86] PCT No.: PCT/IB96/00612

§ 371 Date: Dec. 10, 1997

§ 102(e) Date: Dec. 10, 1997

[87] PCT Pub. No.: WO97/01491

PCT Pub. Date: Jan. 16, 1997

[30] Foreign Application Priority Data

Jun. 27, 1995 [IT] Italy ..... B095A0320

[51] Int. Cl.[6] ..... B65D 43/16

[52] U.S. Cl. ..... 229/125.09; 229/214; 229/125.11; 53/133.2

[58] Field of Search ..... 156/69, 308.4; 53/412, 410, 133.2; 229/125.09, 213, 125.08, 125.01, 125.11, 214

[56] References Cited

U.S. PATENT DOCUMENTS

| | | | |
|---|---|---|---|
| 2,177,919 | 10/1939 | Vogt | 53/133.2 X |
| 2,891,704 | 6/1959 | Morrison . | |
| 2,972,184 | 2/1961 | Andrew | 53/133.2 |
| 4,821,950 | 4/1989 | Sanchez et al. | 229/249 X |
| 5,624,528 | 4/1997 | Abrams et al. | 156/69 X |
| 5,716,471 | 2/1998 | Pape | 156/69 |
| 5,725,121 | 3/1998 | Gianpaolo | 220/375 |

FOREIGN PATENT DOCUMENTS

| | | |
|---|---|---|
| 0 407 746 | 1/1991 | European Pat. Off. . |
| 0 435 279 | 7/1991 | European Pat. Off. . |
| 2 233 315 | 1/1991 | United Kingdom . |
| WO 91/08957 | 6/1991 | WIPO . |

*Primary Examiner*—Gary E. Elkins
*Assistant Examiner*—Iri Mai
*Attorney, Agent, or Firm*—Nims Howes Collison Hansen & Lackert

[57] ABSTRACT

The method, relatively to the fastening of a closure (1) to a container (2) of liquid, granular or powdery products, provided at least of an opening (3) and a pouring opening (4), in which the closure (1) comprises a hub (5) forming a single block, through a flexible tongue (14), with a cap (6) removably matchable to the hub (5), a sheet element (7) sealed to the upper edge (5*b*) of the hub (5), includes: continuous withdrawal from a feeding hopper of each closure (1); inserting into the container (2), through the opening (3), of the hub (5) and an inner portion (14*a*) of the flexible tongue (14); inserting into the pouring opening (4) the hub (5) until the base (5*c*) of this latter matches the inner wall of the container (2); sealing the base (5*c*) to the inner edge of the pouring opening (4); tight sealing the opening (3); overturning the cap (6) onto the relative hub (5).

12 Claims, 2 Drawing Sheets

FIG. 1
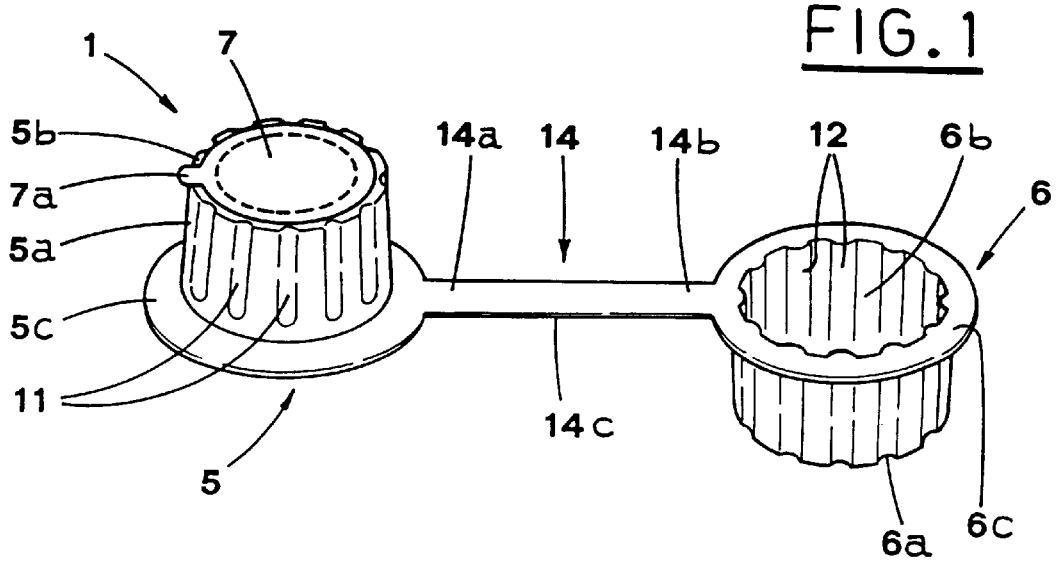
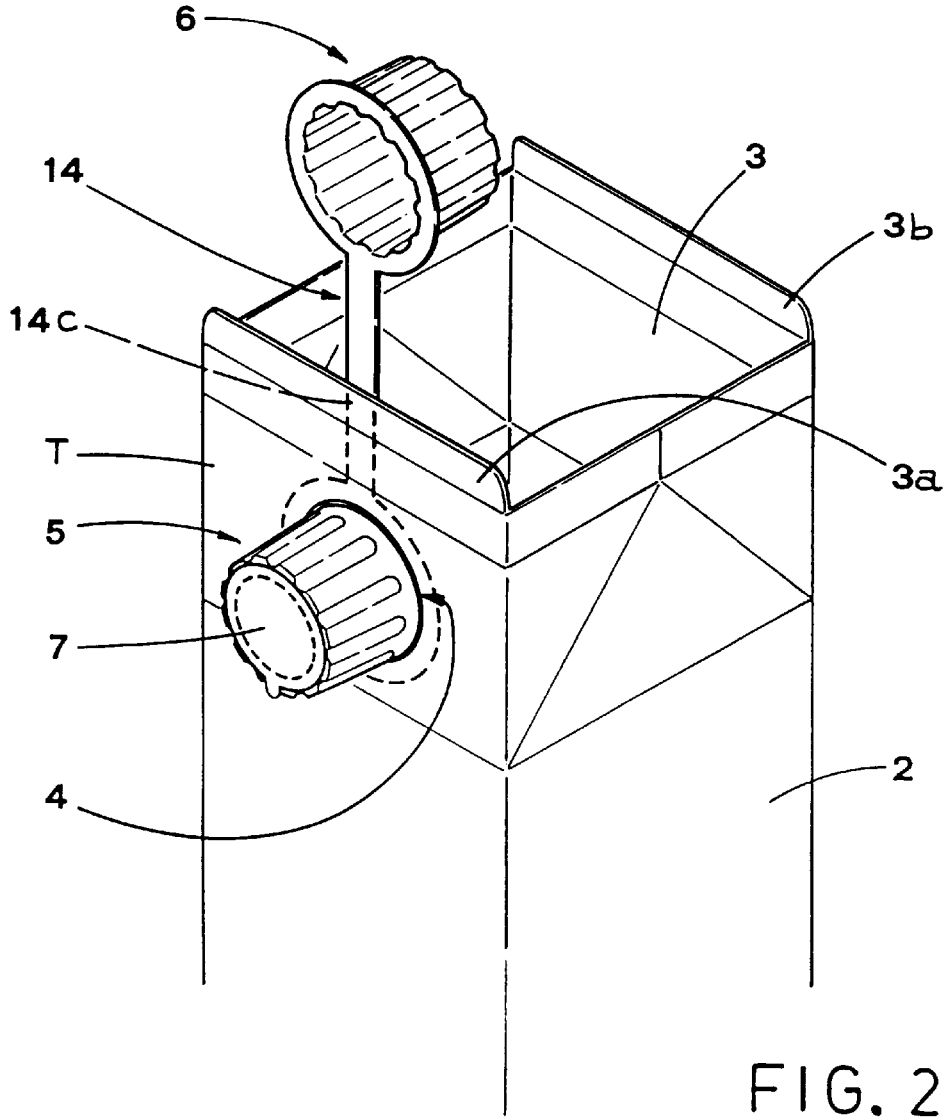
FIG. 2

METHOD FOR FASTENING A CLOSURE TO A CONTAINER OF LIQUID, GRANULAR OR POWDERY PRODUCTS, AND CONTAINER SO ACHIEVED

TECHNICAL FIELD

The present invention concerns the packaging of liquid, granular or powdery products both alimentary and not.

In particular the present invention refers to a method for fastening a closure to a container for liquid, granular or powdery products, and the container so obtained, with said closure particularly suitable for sealing, since packaging, the pouring opening of the container and for saving the aroma of the packaged product after its first fruition from the container.

BACKGROUND ART

It is known that currently containers for liquid, or granular or powdery products are diffused, such as, for drinks or detergents, made by means of semi-stiff or flexible sheet material, suitably folded up and sealed.

Such containers, both with parallelepipedal and bag shape, are folded and closed by means of a first longitudinal welding forming the tubular and a transversal welding in correspondence to the opposite top and bottom edges in such a way that the top is almost flat or has two pitches sloping outside the semi-stiff container.

These containers are often provided with the so called "open and close" devices, fastened to the edges of the pouring opening carried out on the top of each container.

Open and close devices are known mainly including a cap screwable to a hub previously welded onto the edge of the pouring opening, or a so-called "hinged" cap consisting of a base glued to the container onto the borders of the pouring opening and a tongue, hinged and removably couplable to the base, fit to make a tight closure of the container. The more recent embodiments of these last devices include the sealing of the pouring opening with a removable or tearable strip of suitable water-repellent material that is glued upon the edges of the opening in such a way to make a kind of "manufacturer warranty" and "tightness" for the product packaged inside the container before its initial fruition. This strip lies between the container and the tongue of the "open and close" device.

The fastening of such closing devices often has problems because particular apparatuses were carried out so as to be inserted into the pre-existing packaging lines of such containers without "open and close" devices in this way true and real "bottle necks" have been introduced in correspondence with such apparatuses for fastening the "open and close" devices to the containers.

The "open and close" devices fastened to the borders of a pouring opening often comprise also the fastening of the "guarantee seal" tongue so introducing a further snag in the packaging line.

A further disadvantage is that such "open and close" devices are made of thermoplastic material and have relatively high cost in comparison with the container and the packaged product.

Further disadvantage of such closures is that most closures are fixed to containers of liquid, granular or powdery products that normally must be quickly consumed because they are "fresh" products such as milk and fruit juices. In fact, once one of such containers is open for the first fruition it is necessary to consume briefly the remaining packaged product even if the container closure is hermetic. This latter, therefore, must not necessary be hermetic because the "aroma-saving cap" function is the only effectively required function. It is therefore evident that the actual hermetic closures are disadvantageously extremely expensive for the simple functions to be worked out: to save the aroma of the product still packaged inside the container and to insulate temporarily the product from the external environment.

The document GB-A-2233315 discloses a cartoon container spout incorporated into the container and including a membrane, impermeable by the container's contents.

This membrane initially prevents the contents from escaping but is relatively readily penetrated by the end-user without the end-user having to penetrate the carton wall. The membrane is incorporated into the spout region of the container in such a way that, when pulled or penetrated, it parts company with the surrounding spout material to leave a cleanly defined pouring opening in the spout.

A screw cap is provided for re-closing the threaded screw end region of the spout.

This cartoon spout is carried out integral with a closing membrane of its inner lumen, so preventing the filling of the container to which the spout is fixed.

The document EP-A-0435279 discloses a pouring plug for paper containers having flange portion corresponding to peripheral surface portion of fitting hole of container body and mounted from inside container body.

The plug has a threaded cap and a pourer, fitted through a thin wall section and having a lid and pull ring. The plug fitment is supported by a shoulder which contacts the inner edge of the fitting hole The space between the flange and the projection rim is greater than the thickness of the container so that a clearance remains after fitting.

During vibrations caused by container movement the projection shoulder and the flange butt to the edge of the fitting hole so that the fitment remains secure.

The main feature of this fitment is that it cannot be dislodged prior to supersonic fixing of the pouring spout to the container wall and there is no teaching about the method of sealing to a container a heat-deformable closure being sealable both before and/or after the container filling.

In the document EP-A-407746 it is disclosed a box-shaped packaging container with flat gable roof, made of folded plasticised blank and having a spout or adaptor for it in its flat gable roof. At the gable part, the flat roof is closed by a sealed seam and has a folded pocket consisting of triangular folding flaps at one corner.

In the opposite corner, between the flat roof and the adjacent body wall is an inclined surface which forms, together with side pocket surfaces on the adjacent sides a gable pocket inside the square outer shape.

This container is easy to handle, particularly due to the spout design and form, but having neither a very cheap heat-deformable closure, nor a closed end fixable closure.

DISCLOSURE OF THE INVENTION

The main object of the present invention is to propose a method for fastening a closure to a container of liquid, granular or powdery products fit to avoid the snag of the packaging lines of such products.

Another object is to propose a method fit to fasten closures made of heat-deformable material to containers of semi-rigid or flexible material.

A further object is to propose a method for fastening closures to containers so as to guarantee a safe sealing of each container in correspondence with the packaging of a product therein.

Further object of the present invention is to propose a simple method for fastening a closure to a container.

The aforesaid objects are achieved by means of a method for fastening a closure to a container of liquid, granular or powdery products, with this latter at least provided with an opening, delimited by opposite edges of the container, and with a pouring opening, said closure including: a hub defined by a central tubular body, an upper free edge and a base; a cap having a closed end and an open end and removably matchable with said hub; a sheet element sealed to said upper edge of said hub; a flexible tongue, forming a single block with said cap and said base, lying on the same plane of this latter and said open end of said cap; said method characterized in that it comprises: continuous feeding of said containers; continuous withdrawal from a feeding hopper of at least one cited closure; inserting into said container, between said edges delimiting said opening, said hub and an inner portion of said flexible tongue adjacent to this latter in such a way that the remaining external portion of the tongue, as well as said cap fastened thereto, is outside said container; inserting into said pouring opening said hub until said base of this latter matches the inner wall of said container; sealing said base to the inner edge of said pouring opening; sealing together said edges previously disposed opposite so that said tongue is hermetically welded between them in correspondence with its middle portion; overturning said cap onto the relative hub by virtue of refolding said tongue in correspondence to its cited middle portion.

BRIEF DESCRIPTION OF THE DRAWINGS

The characteristic features of the present invention are pointed out in the following description with reference to the enclosed drawings, in which:

FIG. 1 shows an axonometric view of the closure at an initial extended configuration;

FIG. 2 shows an axonometric view of the closure bonding step to the still open container;

BEST MODE OF CARRYING OUT THE INVENTION

Figure 3:
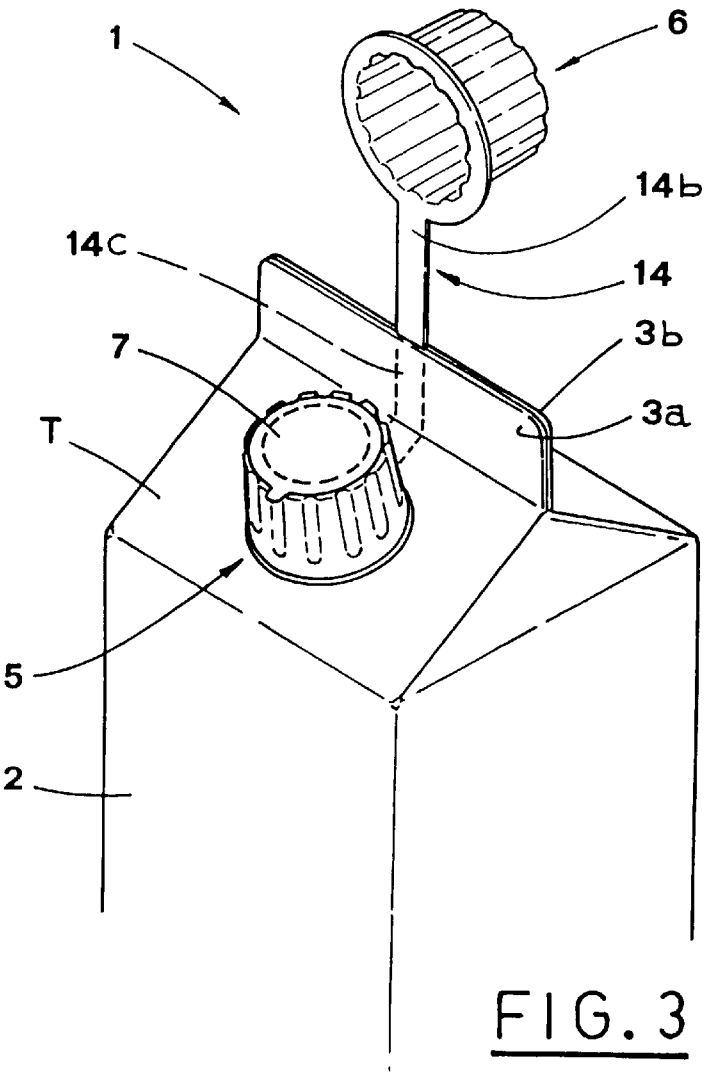
FIG. 3 shows an axonometric view of the closure bonded to the sealed container.
Figure 4:
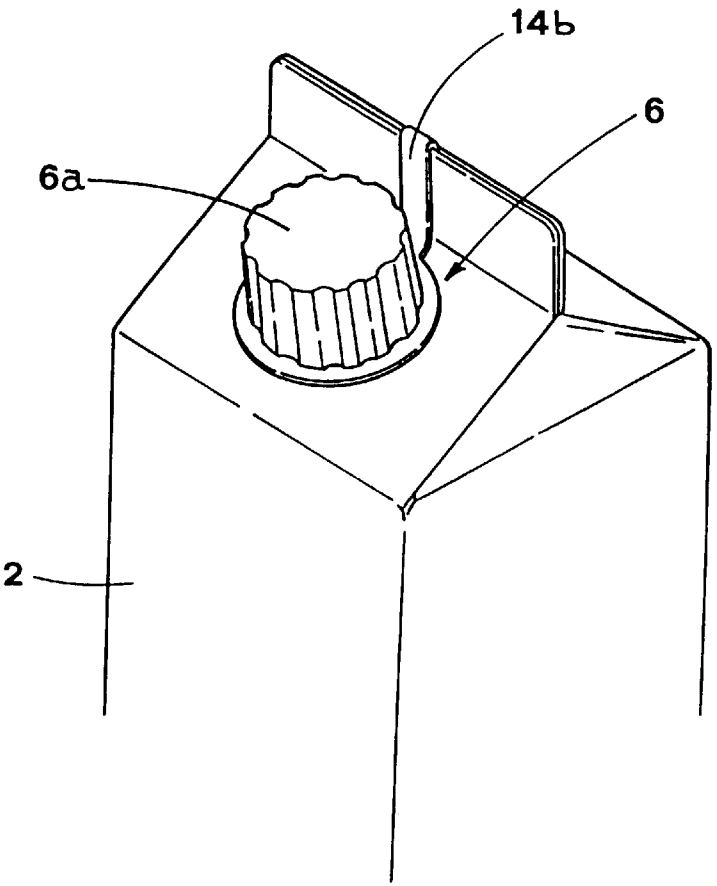
FIG. 4 shows an axonometric view of the closed closure fixed to the sealed container.

With reference to the abovementioned figures, numeral 1 indicates a closure for a container 2 of liquid, granular or powdery products, preferably of parallelepipedal shape with a top T having a pouring opening 4 thereon. Each container 2 is provided at least with an opening 3, delimited by opposite edges 3*a* and 3*b* of the top T.

This closure 1 includes a hub 5 having a removably cap 6 hinged thereto by means of a flexible tongue 14.

The hub 5 is defined by a tubular central body 5*a*, an upper free edge 5*b* and a base 5*c* preferably consisting of a flange, having a flat surface, outwardly protruding from the central body 5*a*. The external surface of the tubular central body 5*a* preferably has a series of recesses 11 disposed along an axial direction.

The cap 6 has a closed end 6*a* and an open end 6*b*, between which a tubular body extends preferably having recesses 12 disposed axially and outwardly provided with an external flange 6*c* at the position of the open end 6*a*. Moreover the cap 6 and the hub 5 have an almost complementary structure.

The flexible tongue 14, forming a single block with the external flange 6*c* of the cap 6 and the base 5*c* of the hub 5, is initially disposed on the same plane of the base 5*c* and the flange 6*c*.

A sheet element 7 is peripherally welded hermetically upon the upper edge 5*b* of the hub 5. This element 7 has a tab 7*a* protruding from its side edge by virtue of which the removal of the sheet element from this hub 5 is made easer in correspondence with the fruition of the product packaged inside the container 2.

The method, for fastening such a closure 1 to a container 2 previously described, comprises the following steps: continuous feeding of the upright containers 2, having the top T upward; continuous withdrawal from a feeding hopper of a closure 1; inserting into the container 2, between the edges 3*a* and 3*b* of the head T, the hub 5 and an inner portion 14*a* of the flexible tongue 14 adjacent to this latter in such a way that the remaining external portion 14*b* of the tongue is outside to the container 2 together with the cap 6 bonded thereto; inserting the hub 5 into the pouring opening 4 until its base 5*c* stops against the inner wall of the container 2 next to the pouring opening 4; sealing the base 5*c* to the inner edge of the pouring opening 4, for instance by means of heat or ultrasonic seal; product dosing inside the container 2 through the opening 3; sealing the edges 3*a* and 3*b* of the top T previously set opposite in such a way that between them the tongue 14 is hermetically welded in correspondence with its middle portion 14*c*; overturning the cap 6 onto the relative hub 5 by virtue of yielding and refolding the tongue 14 between its middle portion 14*c* and external portion 14*b*.

A variant of the method comprises the continuous feeding of the containers 2 instead of at upright position, that is with the relative top T oriented upward, at laid down position, for instance settled on a side wall. The step sequence of the present method is substantially unchanged with the only variation that the erection step of the container 2 is added before the step relative to the product dosing within the same container.

A variant of the method comprises moreover that the container 2 has a second opening, known and not illustrated, for instance in correspondence with the bottom of the container whose opposite flaps are not still sealed. In this condition the method comprises the product dosing inside the container 2 immediately after the overturning of the cap 6 onto the relative hub 5 and the overturning of the container so that this latter has the top T downward and the still open bottom is turned upward.

A further variant of the method includes that the closure 1 is bonded to the container without having any sheet element 7 welded to the upper edge 5*b* of the hub 5. In this condition the method steps differ from the preferred embodiment only for the fact that after the sealing step of the edges 3*a* and 3*b* of the top T, the product dosing inside the container 2 is carried out through the hub 5. Therefore the subsequent step comprises the sealing of the sheet element 7 in correspondence to the upper edge 5*b* of the hub 5.

The feeding unit of the closures 1 consists of a hopper, known and not illustrated, in which the closure 1 are helter-skelter and are withdrawn singularly by virtue of their selective separation preferably through a vibratory device, also known and not illustrated, of the closures 1 provided in this feeding unit.

The closures 1 used for carrying out this method are made of heat-deformable plastic material, while the containers 2 are indifferently made of heat-deformable plastic material or flexible or semi-stiff material.

The carrying out of the abovementioned method with its variants causes the making of a hermetically closed container, filled with packaged product, having a closure 1 in which a sealing and hermetic sheet element 7 could be pulled up to benefit by the product packaged inside the container. This closure has the peculiarity of both being reclosable not hermetically and with the simple object of saving the aroma of the product still packaged and having a portion of the tongue 14, forming a hinge for the cap 6 fastened to the hub 5, inside the container 2 so allowing an easier, precise and quick subsequent closure.

The main advantage of the present invention is to provide a method for fastening a closure to a container of liquid, granular or powdery products without slowing at all the production process of a packaging line of the products.

Another advantage is to provide a method for fastening heat-deformable material closures to containers of semi-stiff, flexible or heat-deformable material.

A further advantage is to provide a method for fastening closures to containers allowing the safe sealing thereof in correspondence of the product packaging inside the relative container.

Further advantage of the present invention is to provide a simple and effective method for fastening a closure to a container.

I claim:

1. A method for fastening a closure (1) to a container (2) for a liquid, granular or powdery product, the method comprising:

providing a container (2) having an opening (3), delimited by opposite edges (3*a*) and (3*b*) of the container, and a pouring opening (4);

providing at least one closure (1) having a hub (5) defined by a central tubular body (5*a*), an upper free edge (5*b*) and a base (5*c*), a cap (6), having a closed bottom (6*a*) and an open bottom (6*b*), removably matable with the hub (6), a sheet element (7) sealed to the upper edge (5*b*) of the hub, a flexible tongue (14) forming a single block with the cap (6) and the base (5*c*), the tongue lying on the same plane of the base and of the open bottom (6*b*) of the cap (6);

inserting the hub (5) and an inner portion (14*a*) of the flexible tongue (14) into the container (2) between the edges (3*a*), (3*b*) delimiting the opening (3), such that a remaining external portion (14*b*) of the flexible tongue is outside the container (2);

inserting the hub (5) into the pouring opening (4) until the base (5*c*) of the hub mates to an inner wall of the container (2);

sealing the base (5*c*) to an inner edge of the pouring opening (4);

moving the edges (3*a*) and (3*b*) into contact with each other thereby closing the opening (3), and sealing together the edges (3*a*) and (3*b*) such that the tongue (14) is hermetically welded between them in a middle portion (14*c*) thereof; and overturning the cap (6) onto the hub (5).

2. The method according to claim 1, further comprising providing the container (2) in an upright position and dosing the product into the container immediately after the sealing of the base (5*c*) of the hub (5) to the inner edge of the pouring opening (4).

3. The method according to claim 1, further comprising providing the container (2) horizontally on one side, and uprighting the container and then dosing the product into the container immediately after the sealing of the base (5*c*) of the hub (5) to the inner edge of the pouring opening (4).

4. The method according to claim 1, further comprising providing a second opening in a bottom of the container (2) and, immediately after overturning of the cap onto the hub (5), locating the second opening in an upright position and dosing the product into the container through the second opening.

5. The method according to claim 1, wherein the closure (1) is made of a heat sealable plastic material.

6. A method for fastening a closure (1) to a container (2) for a liquid, granular or powdery product, the method comprising:

providing a container (2) having an opening (3), delimited by opposite edges (3*a*) and (3*b*) of the container, and a pouring opening (4);

providing at least one closure (1) having a hub (5) defined by a central tubular body (5*a*), an upper free edge (5*b*) and a base (5*c*), a cap (6), having a closed bottom (6*a*) and an open bottom (6*b*), removably matable with the hub (6), a flexible tongue (14) forming a single block with the cap (6) and the base (5*c*), the tongue lying on the same plane of the base and of the open bottom (6*b*) of the cap (6);

inserting the hub (5) and an inner portion (14*a*) of the flexible tongue (14) into the container (2) between the edges (3*a*), (3*b*) delimiting the opening (3), such that a remaining external portion (14*b*) of the flexible tongue is outside the container (2);

inserting the hub (5) into the pouring opening (4) until the base (5*c*) of the hub mates to an inner wall of the container (2);

sealing the base (5*c*) to an inner edge of the pouring opening (4);

moving the edges (3*a*) and (3*b*) into contact with each other thereby closing the opening (3), and sealing together the edges (3*a*) and (3*b*) such that the tongue (14) is hermetically welded between the edges in a middle portion (14*c*) thereof;

dosing the product into the container (2) through the hub 5;

sealing a sheet element (7) to the upper edge (5*b*) of the hub (5); and overturning the cap (6) onto the hub (5).

7. The method according to claim 6, wherein the closure (1) is made of a heat sealable plastic material.

8. A container for a liquid, granular or powdery product, comprising:

a top (T), having hermetically welded edges (3*a*, 3*b*), and a pouring opening (4), a closure provided with the pouring opening, the closure having a hub (5) defined by a central tubular body (5*a*), an upper edge (5*b*) and a base (5*c*), the closure welded to an inner edge of the pouring opening (4), a cap (6), having a closed bottom (6*a*) and an open bottom (6*b*), removably matable with the hub (5), a sheet element (7) welded to the upper edge (5*b*) of the hub (5), a flexible tongue (14), forming a single block with said cap and said base, the tongue lying on the same plane of the base and of the open bottom (6*b*) of cap (6), the container (2) having, inside the container, both the base (5*c*) of the hub (5) and an inner portion (14*a*) of the tongue (14), the container having, outside the container, an outer portion (14*b*) of the tongue (14), the cap (6) and the central body (5*a*) of the hub, the tongue (14) having a middle portion (14*c*) hermetically sealed between the edges (3*a*, 3*b*) of the top (T).

9. The container according to claim 8, wherein the base (5*c*) of the hub (5) and the middle portion (14*c*) of the tongue (14) are heat sealed to the container (2).

10. The container according to claim 8, wherein the container is made of a flexible material.

11. The container according to claim 8, wherein the container is made of a semi-stiff material.

12. The container according to claim 8, wherein the container is made of a heat deformable material.

* * * * *